US005276935A

United States Patent [19]

Lemon et al.

[11] Patent Number: 5,276,935

[45] Date of Patent: Jan. 11, 1994

[54] MEDICAMENT CONTAINING DENTAL BRUSH

[75] Inventors: J. Robert Lemon, Charlotte; William T. Evans; Robert E. Christian, both of Batesville, all of Ark.

[73] Assignee: Professional Dental Technologies, Inc., Batesville, Ark.

[21] Appl. No.: 697,739

[22] Filed: May 3, 1991

Related U.S. Application Data

[63] Continuation of Ser. No. 512,915, Apr. 23, 1990, abandoned.

[51] Int. Cl.[5] ..... A46B 11/00

[52] U.S. Cl. ..... 15/104.94; 15/167.1

[58] Field of Search . 15/167.1, 210 R, 244.2, 104.94; 300/21, 300/7; 128/267; 424/435

[56] References Cited

U.S. PATENT DOCUMENTS

| | | | |
|---|---|---|---|
| 2,099,688 | 11/1937 | Hill et al. | 15/167.1 |
| 2,167,761 | 8/1939 | Levin et al. | 15/167.1 |
| 2,175,487 | 10/1939 | Stall | 300/21 |
| 2,294,900 | 9/1942 | Fuller | 15/167.1 |
| 2,419,896 | 4/1947 | Hobelmann | 15/167.1 |
| 2,667,655 | 2/1954 | Halford, Jr. | 15/210 R |
| 2,750,614 | 6/1956 | Collins et al. | 15/210 R |
| 2,816,312 | 12/1957 | Beck et al. | 15/210 R |
| 2,939,164 | 6/1960 | Rosenthal | 300/21 |
| 3,613,143 | 10/1971 | Muhler et al. | 15/167.1 |
| 3,818,911 | 6/1974 | Fournier | 15/244.2 |
| 4,152,804 | 5/1979 | Morris | 15/167.1 |
| 4,869,277 | 9/1989 | Olsen | 300/7 |
| 5,061,106 | 10/1991 | Kent | 15/104.94 |

*Primary Examiner*—Harvey C. Hornsby
*Assistant Examiner*—Patrick F. Brinson
*Attorney, Agent, or Firm*—McAulay Fisher Nissen Goldberg & Kiel

[57] ABSTRACT

A medicament containing dental brush includes a plurality of parallel fibers having a medicament such as tetracycline, chlorhexidine, or sodium fluoride disposed between or within the individual fibers. The medicament is released during brushing to provide direct contact of the medicament with the areas in the mouth receiving treatment, including those areas both above and below the gum line. The brush is disposable and contains a sufficient dosage for one use and is preferably used with a rotary toothbrush. Utilizing a dental brush as a means for delivery of the medicament to a treatment area, increases the effectiveness of the treatment.

17 Claims, 1 Drawing Sheet

MEDICAMENT CONTAINING DENTAL BRUSH

This is a continuation of application Ser. No. 07/512,915 filed Apr.23, 1990 abandoned.

TECHNICAL FIELD

This invention relates to dental brushes, and more particularly to dental brushes impregnated with a medicament for slow release during brushing.

BACKGROUND OF THE INVENTION

Plaque is the leading cause of tooth decay and periodontal disease, affecting approximately 90% of the adult population. Plaque is a sticky colorless layer of harmful bacteria that is constantly forming on teeth and gums. To reduce the incidence of periodontal disease, plaque should be removed at least one a day. Generally, the typical means for removing plaque deposits involves brushing using a toothbrush, preferably combined with use of dental floss and/or toothpicks. Recently, the use of rotary electric toothbrushes has gained favor as a more effective means for removing plaque and, therefore, for preventing or reducing the incidence of periodontal disease.

While these methods are effective in removing plaque formed on teeth, periodontal disease is still prevalent in the adult population and, consequently, means for treatment of the periodontal disease is gaining attention. In particular, attempts have been made to develop means for delivering various medicaments to the areas subject to periodontal disease and other diseases, in order to effectively combat these diseases in place. Most such diseases are caused by bacteria located below the gum line. Generally, mouthwash is the preferred means for delivering medicaments to the diseased areas. However, such mouthwashes suffer from the inability to penetrate significantly below the gum line and, therefore, may not, in fact, contact the diseased areas. Consequently, additional means for delivering medicaments to diseased tissue below the gum line are being sought.

SUMMARY OF THE INVENTION

According to the present invention, a disposable dental brush is disclosed which is impregnated with a medicament such that during brushing and penetration of the gum line by the brush bristles, the medicament contained in the brush is delivered to the diseased areas. This is accomplished by providing a brush having soft bristles and having sufficient spacing between the bristles for accommodating a dosage of a medicament, the medicament applied to the brush through impregnation. After impregnation, depending on the choice of medicament, the brush may be dried or packed in a solution containing package. Medicament release occurs during brushing.

Utilizing a disposable brush which contains a dosage of a medicament for release during brushing provides for the medicament to aggressively reach the site of the disease in order to more effectively combat the disease. In addition, the cleansing action of the brush removes the surface layers of plaque protecting the bacteria, increasing the effectiveness of the treatment. Since the brush bristles are soft, they easily slide beneath the gum and both cleanse and deliver the medicant to the source of need. The types of medicaments which could be applied include anti-microbials, anti-virals, anti-inflammatories, surfactants, sealants, whitening or bleaching agents.

DESCRIPTION OF THE PREFERRED EMBODIMENT

Figure 1:
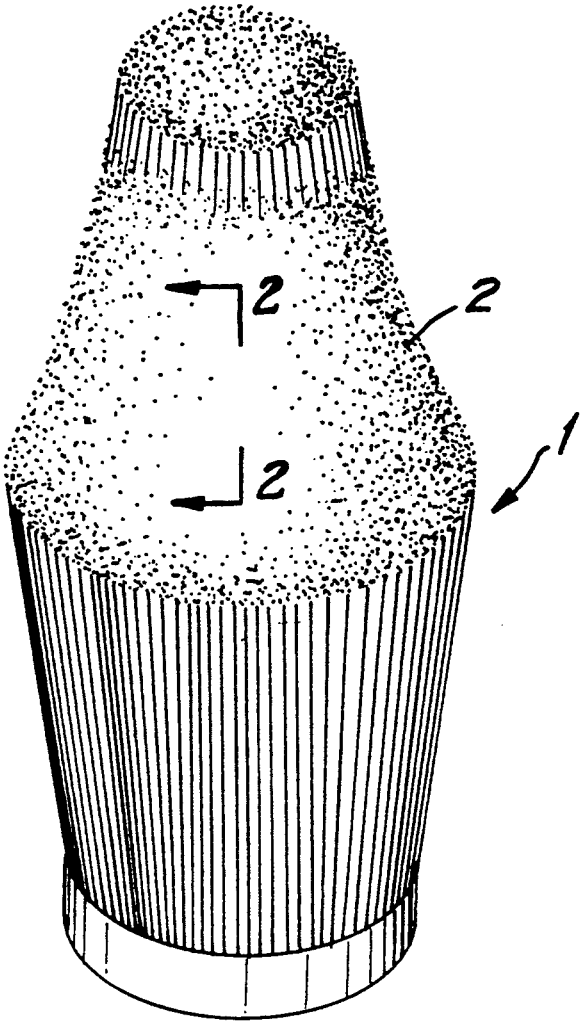
FIG. 1 is a perspective view of a dental brush including a medicament contained therein.

Referring to FIG. 1, a circular brush tip 1 adaptable for use in a rotary toothbrush is shown. The brush tip 1 comprises a bundle of parallel, thin threads or fibers 2 of a suitable material, such as heat weldable nylon materials such as polyamide or a similar suitable material. For instance, a nylon fiber material with a designation Dupont code 0900MA can be used. Generally, there may be between 1,000 and 5,000 fibers in the bundle. Apparatus and methods for producing such a brush tip are disclosed in U.S. Pat. No. 4,869,277 to Olsen, which is hereby incorporated by reference. However, it should be understood that many other brush constructions would be adaptable for incorporating a medicament therein and, therefore, this invention is not limited to such a description, and the description pursuant to use with a rotary toothbrush is merely done for illustrative purposes and as a preferred means for using the medicament containing brush tip of the present invention.

While of any conventional construction, the brush tip is preferably composed with soft fibers which are sufficiently flexible to allow invasion below the gum line, in order to deliver the medicament to the site of the disease. In addition, it may be preferable to include a plurality of center long fibers surrounded by shorter fibers in order to encourage the longer fibers to penetrate the gum line.

Figure 2:
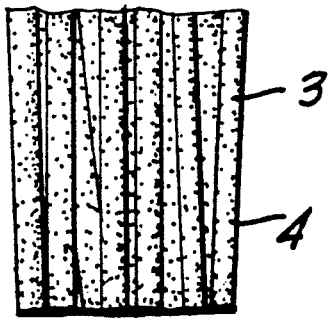
FIG. 2 is an enlarged view taken along the line 2-2 of FIG. 1, showing the medicament contained between the brush filaments.

FIG. 2 shows an enlarged cross sectional view of the brush tip 1. A medicament 3 is adhered to and coats fibers 4. Since the medicament is contained within the brush, it cannot be removed through abrasion or other means during handling or packaging and will remain on the brush fibers until contacted with a material such as saliva, water or mouth rinse which will dissolve and/or release the medicament from the fibers. Various polymers could also be used to enhance adhesion of the medicament prior to the desired release. Since the medicament is not chemically bonded to the fibers, it will generally be removed through contact with water or saliva or through physical contact during brushing and thus will be released upon contact with the teeth and gums.

Figure 4:
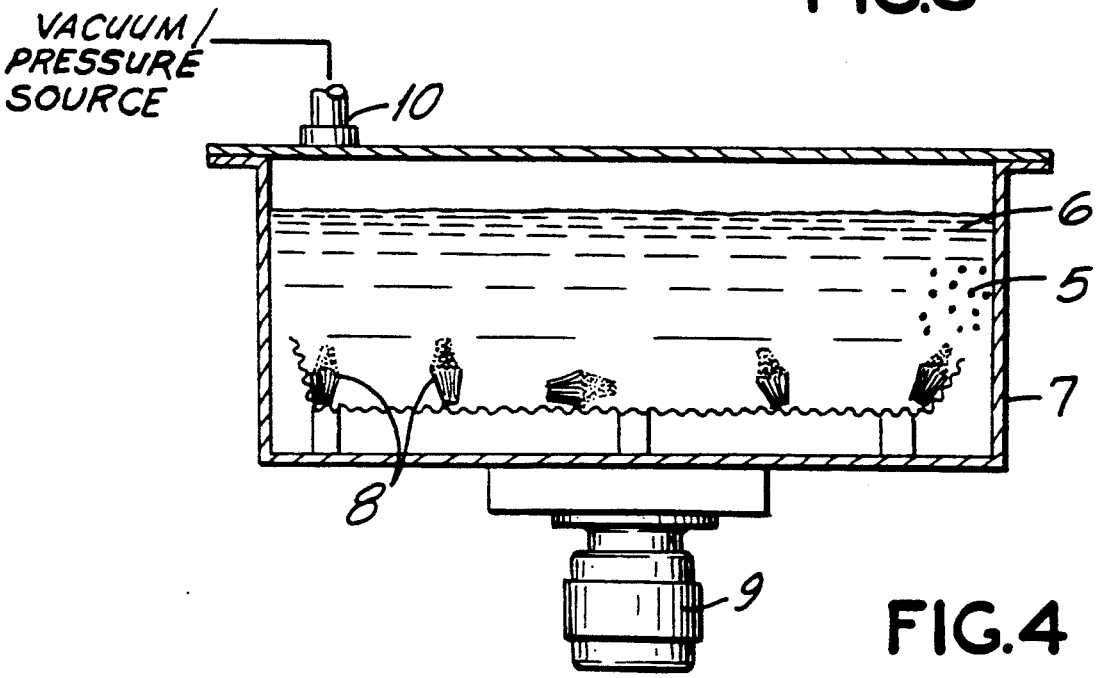
FIG. 4 is a perspective view of the equipment used for impregnating the brush with a medicament.

The preferred method for incorporating the medicament in the brush tip is by solvent impregnation and drying. Referring to FIG. 4, A medicament 5 is dissolved in a solvent 6 disposed within a tank 7. Brush tips 8 are immersed in the tank and impregnated therein. Impregnation may also occur through dipping, spraying or other means using the solvent medicament mixture. Capillary action may assist in drawing the solvent into the brush between the fibers, and optionally, pressure or agitation may be used. Referring again to FIG. 4, the tank 7 has an agitator 9 and a connection 10 for applying pressure or vacuum. The capillary action may also be enhanced by placing the brushes under vacuum prior to impregnation. The brush tips are then removed and the solvent evaporated by drying, leaving a residue of medicament directly on the brush fibers.

Generally, the sizing of the brush tip and amount of medicament disposed on the fibers is such that essentially a single use will release substantially all the medicament and that thereafter the brush will be disposed of and replaced by a second medicament containing brush.

Medicaments usable with the present invention include, but are not limited to, the following; keratinizing agents, topical anesthetic or desensitizing agents, anti-microbials, anti-virals, surfactants, sealants, tetracycline, cetylpyridium chloride, chlorhexidine, hexachlorophene, zinc ascorbate, sodium fluoride, stannous fluoride, thymol and eucolyptol. Such medicaments should be soluble or suspendable in an evaporable solvent for incorporation in the brush. In addition, the solvent should be compatible with the materials from which the brush tip is made. For example, with a nylon brush having nylon bristles, suitable solvents include water, isopropyl alcohol, ethyl alcohol, glycerin, ethylene chloride, propylene glycol, etc. While solvent impregnation is preferred, other means for including the medicament in the brush are contemplated. For example, the medicament may be gelled between the fibers and thus, maintained in a semi-solid state prior to use.

Figure 3:
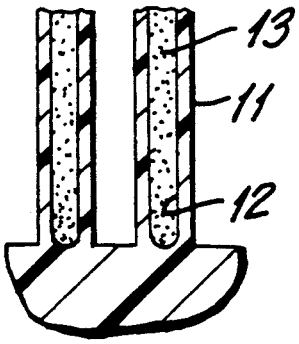
FIG. 3 is an enlarged view of an alternative embodiment using hollow fibers filled with medicament.

Another method for delivering the medicament is to include a plurality of hollow fibers, rather than solid fibers, in the brush tip and to draw the dissolved medicament into the individual fibers through capillary action. Referring to FIG. 3, a hollow fiber 11 has a cavity 12 containing a medicament 13. This embodiment may be particularly useful with liquid medicaments. Another alternative embodiment of the present invention would involve the use of extremely absorptive fiber materials, similar to a sponge, or incorporating the medicament into the fibers before construction of the brush tip. For example, absorptive cellulose fibers may be fabricated with a medicament incorporated therein. As the fibers dissolve during brushing, the medicament is released. The hollow fibers 11 may also be made of a dissolvable material.

It is also contemplated that combination brushes can be used, for example, having a plurality of fibers 4 mixed with a plurality of fibers 11 to increase both brushing effectiveness and medicament delivery.

Combining the medicament containing brush tip with a rotary toothbrush provides a particular advantage through direct delivery of the medicament to the areas below the gum line which are inaccessible to direct liquid contact when a mouthwash is used. Consequently, more effective treatment can be achieved to help improve oral health, such as to reduce periodontal damage. Also, such a system provides a home delivery system for applying these medicaments effectively, enabling a patient to apply timed doses to selected areas. This generally increases the overall effectiveness of the treatment at a minimal cost. Of course, a standard toothbrush could also be impregnated as discussed, but using a rotary toothbrush is preferred.

While a rotary toothbrush has been described, it will be understood by those skilled in the art that various other brushes which do not utilize a rotary action could be used with the present invention without varying therefrom. It will be understood by those skilled in the art that various brush constructions in terms of fibers lengths, densities, and means of attachment, such as bonding, banding, or the use of adhesives, may be used to produce the brush. In addition, the choice of medicament is virtually limitless as numerous drugs now available and available in the future could be adapted for use with the present invention.

I claim:

1. A dental brush for delivering a medicament comprising:

a base, a plurality of fibers extending from said base, said fibers being soft fibers sufficiently flexible to allow invasion of the fibers below the gum line, the base attachable to handle means, and, a releasable medicament combined with the fibers, the medicament released during brushing and penetration of the gum line by the brush fibers for delivery of the medicament to areas below the gum line.

2. The brush of claim 1, wherein the brush is impregnated with the medicament.

3. The brush of claim 1, wherein the fibers are hollow and filled with the medicament.

4. The brush of claim 1, wherein the fibers are made of an absorptive material for holding the medicament until brushing occurs.

5. The brush of claim 1, wherein the medicament is from the group consisting of keratinizing agents, topical anesthetic or desensitizing agents, anti-microbials, anti-virals, surfactants, sealants, tetracyclin, cetylpyridium chloride, chlorhexidine, hexachlorophene, zinc ascorbate, thymol and eucolyptol.

6. The brush of claim 1, wherein the medicament is a water or salvia releasable medicament.

7. The brush of claim 1 further comprising a binder added to the medicament to adhere the medicament to the fibers.

8. The brush of claim 3, wherein the fibers are slowly dissolvable in use.

9. A method for producing a dental brush for delivering a medicament to areas below the gum line, the medicament being releasable during brushing, comprising:

providing a brush having a base, a plurality of fibers extending from the base, said fibers being soft fibers sufficiently flexible to allow invasion of the fibers below the gum line, the base attachable to handle means;

combining a releasable medicament with the plurality of fibers for release of the medicament; brushing and penetrating the gum line by the brush fibers, for delivering the medicament to areas below the gum line.

10. The method of claim 9, wherein the medicament is combined with the fibers by impregnation, the medicament disposed between the fibers.

11. The method of claim 9, wherein the fibers are hollow and the medicament is disposed in the fibers.

12. The method of claim 10, further comprising mixing the medicament with a solvent before impregnation.

13. The method of claim 12, further comprising removing the solvent after impregnation to leave the medicament with the fibers.

14. The method of claim 9, further comprising mixing the medicament with a binder prior to combining with the fibers.

15. The method of claim 10, wherein the medicament is combined with the fibers by dipping in a medicament solution and drying.

16. The method of claim 9, wherein the medicament is from the group consisting of keratinizing agents, topical anesthetic or desensitizing agents, anti-microbials, anti-virals, surfactants, sealants, tetracyclin, cetylpyridium chloride, chlorhexidine, hexachlorophene, zinc ascorbate, thymol and eucolyptol.

17. A method for treating the teeth and gums utilizing a dental brush as a medicament delivery means comprising:

providing a dental brush for delivering a medicament having a base, a plurality of fibers extending from said base, said fibers being soft fibers sufficiently flexible to allow invasion of the fibers below the gum line, the base attachable to handle means, combining a releasable medicament with the fibers, brushing the teeth and gums with the medicament containing dental brush, and, releasing the medicament during brushing and penetration of the gum line by the brush fibers, for delivery of the medicament to areas below the gum line.

* * * * *